US005676521A

United States Patent [19]

Haynes

[11] Patent Number: 5,676,521

[45] Date of Patent: Oct. 14, 1997

[54] STEAM TURBINE WITH SUPERHEAT RETAINING EXTRACTION

[76] Inventor: Christopher J. Haynes, 73 Col.Christopher Green Rd., Portsmouth, R.I. 02871

[21] Appl. No.: 685,947

[22] Filed: Jul. 22, 1996

[51] Int. Cl.[6] ..... F01D 25/00

[52] U.S. Cl. ..... 415/169.1; 415/169.4

[58] Field of Search ..... 415/169.1, 169.2, 415/169.3, 169.4, 108

[56] References Cited

U.S. PATENT DOCUMENTS

| | | | |
|---|---|---|---|
| 875,111 | 12/1907 | Samuelson | 415/144 |
| 1,165,922 | 12/1915 | Wagner | 415/169.4 |
| 1,692,537 | 11/1928 | Baumann . | |
| 1,696,002 | 12/1928 | Hanzlik | 415/169.4 |
| 2,247,378 | 7/1941 | Hinrichs . | |
| 2,823,891 | 2/1958 | Baker et al. . | |
| 3,176,958 | 4/1965 | Ryall . | |
| 3,632,225 | 1/1972 | Smith | 415/169.4 |
| 3,746,462 | 7/1973 | Fukuda | 415/115 |
| 3,746,463 | 7/1973 | Stock et al. | 415/136 |
| 4,513,975 | 4/1985 | Hauser et al. | 277/22 |
| 4,804,310 | 2/1989 | Fuller et al. | 415/115 |
| 4,900,223 | 2/1990 | Groenendaal | 415/190 |
| 4,915,581 | 4/1990 | Groenendaal, Jr. et al. | 415/169.4 |
| 4,979,873 | 12/1990 | Bortilsson | 415/144 |

FOREIGN PATENT DOCUMENTS

| | | | |
|---|---|---|---|
| 896203 | 7/1943 | France . | |
| 726982 | 10/1942 | Germany . | |
| 290097 | 7/1953 | Switzerland . | |
| 688717 | 11/1979 | U.S.S.R. | 415/169.4 |

*Primary Examiner*—John T. Kwon
*Attorney, Agent, or Firm*—Ross, Ross & Flavin

[57] ABSTRACT

The improvement of this invention comprises a seal or other means for closing portions of the flow path between blade carriers for extraction steam as it leaves the main flow path of a steam turbine. The seal prevents the extraction of steam from most of the circumference of the turbine, allowing steam to be extracted only from a portion of the circumference. Hot tip leakage steam is thus retained in the turbine over those portions of the circumference where the seals close the extraction flow path wherein it is of substantial benefit in driving the turbine but is of little benefit when used for heating feedwater, with the colder steam being extracted in its place so that the total amount of steam extracted for heating feedwater is essentially unchanged.

8 Claims, 8 Drawing Sheets

STEAM TURBINE WITH SUPERHEAT RETAINING EXTRACTION

BACKGROUND OF THE INVENTION

1. Field of the Invention

This invention relates to the extraction of steam from a turbine for heating purposes.

2. Description of the Prior Art

FIG. 1 illustrates portions of a prior art conventional steam turbine 10.

Turbine 10 includes a rotor 12 and a housing 16, known as a cylinder, which includes an upper shell 18 and a lower shell 20, which are connected by bolts, not shown.

Attached to rotor 12 are several rows of rotating fan type blades 22 which are evenly spaced around the circumference of the rotor. Ten rows of rotating blades 22 are illustrated.

Alternating with each row of rotating blades 22 is a row of stationary fan type blades 24, which are also evenly spaced around the circumference. Ten rows of stationary blades 24 are illustrated.

Stationary blades 24 are attached to blade carriers 26 and 28 which are annular members, split at the horizontal plane into upper and lower halves which are connected by bolts, not shown.

Blade carriers 26 and 28 are supported by and fixed to the cylinder at top and bottom.

Some practitioners of the turbine art use the term "diaphragms" to refer to blade carriers 26 and 28.

During operation, superheated steam at high pressure from a boiler, not shown, is conveyed through piping and valves, also not shown, to an inlet pipe 32 which discharges into an inlet bowl 34, which is an annular cavity formed by rotor 12, housing or cylinder 16, and blade carrier 26.

The superheated steam flows from inlet bowl 34 and through a steam path 36 which is comprised of the alternating rows of stationary blades 24 and rotating blades 22.

Referring to FIG. 2, two rows each of stationary blades 24 and rotating blades 22 are graphically illustrated.

In FIG. 2, steam flows through the spaces between blades 22 and 24. Stationary blades 24 act as nozzles causing the steam to accelerate to high velocity by losing pressure and temperature, and directing the steam so that it impacts upon the following row of rotating blades 22. The steam surrenders its momentum and kinetic energy to the rotating blades, forcing them to move in a tangential direction, which causes rotor 12 to spin.

Referring once again to FIG. 1, after leaving the row of rotating blades 22, the steam enters the next row of stationary blades 24, where the process is repeated, until the steam reaches an exhaust bowl 38, which is an annular cavity formed by rotor 12, housing or cylinder 16 and blade carrier 28. The steam exits exhaust bowl 38 through an exhaust connection 40 and flows through a low pressure turbine and a condenser, not shown.

The steam leaving exhaust bowl 38 through exhaust connection 40 may still be at a state of high pressure, temperature and enthalpy. Nevertheless, its pressure, temperature, and enthalpy will be significantly less than at inlet bowl 34.

A fraction of the steam is extracted from steam path 36 through an extraction gap 42 between blade carriers 26 and 28 into an extraction belt 44 which is an annular cavity formed by housing or cylinder 16 and blade carriers 26 and 28.

In the prior art showing of FIG. 1, extraction gap 42 constitutes an opening between blade carriers 26 and 28 whose width is uniform around the entire circumference of turbine 10. The extracted steam exits extraction belt 44 through an extraction connection 45 and flows through a connecting pipe, not shown, to be used in a heat exchanger, also not shown, known as a feedwater heater, for heating boiler feedwater.

Steam is condensed in the feedwater heater at a rate that depends on the flow rate and temperature of the boiler feedwater being heated. As soon as it is condensed, additional steam will be extracted from steam path 36 through extraction gap 42 to extraction belt 44 through extraction connection 45 thence through connecting piping to the feedwater heater, not shown.

A variation of the prior art structure of FIG. 1 is shown in FIG. 3, wherein a turbine 110 has a single blade carrier 126 which is divided into an upper half 128 and a lower half 129, joined by bolts, not shown.

Blade carrier 126 has an extraction gap 142 at the same location as extraction gap 42 of FIG. 1, providing a similar path for extraction steam to escape from a steam path 136 to an extraction belt 144.

Turbine 110 of FIG. 3 is otherwise identical to turbine 10 of FIG. 1, and similar reference numbers are employed to designate similar parts therein.

In the embodiments of FIGS. 1 and 3, the pressure and temperature of the steam flowing through the portion of the steam paths 36, 136 adjacent extraction gaps 42, 142, is at some intermediate level between the pressure at inlet bowl 34 and the pressure at exhaust bowl 38.

In both FIG. 1 and FIG. 3, the pressure in extraction belts 44, 144 is slightly lower than the pressure in the portion of steam paths 36, 136 adjacent extraction gaps 42, 142, the slight difference in pressure being necessary to force the steam through extraction gaps 42, 142. Any such difference in pressure has an adverse effect on the efficiency of the power plant. For this reason, the pressure difference, and its attendant loss in efficiency, are kept small by using extraction gaps 42, 142 of generous width.

Referring to the prior art showing of FIG. 4, the peripheries of several adjacent rotating blades 22 of the same row are connected to a shroud band 46. Each rotating blade 22 is connected to a shroud band, so that several shroud bands 46 form a ring around the entire circumference, with only slight interruptions between individual shroud bands.

Attached to blade carrier 26 is a tip seal 48 which is a strip of metal locked into an annular groove 50 in the blade carrier.

As seen in FIG. 5, a series of such tip seals 48 forms an annular ring around the entire circumference of turbine 10, with only slight interruption between individual tip seals.

With reference once again to FIG. 4, the distance between the outside circumference of shroud band 46 and the inside circumference of tip seal 48 is known in the art by the name tip seal clearance. The tip seal clearance is typically about 1/20th of an inch and is designated in FIG. 4 by the numeral 52.

During operation, most of the steam passing through turbine 10 flows across rotating blades 22. A small fraction of the steam passes through tip seal clearance 52 between shroud band 46 and tip seal 48. This steam is known in the art by the name tip leakage steam. In large turbines, the mass flow rate of tip leakage steam at one row of blades can be 50,000 lbs. per hour. The pressure of the tip leakage steam at the exit of tip seal clearance 52 will be equal to the pressure of the steam at the exit of rotating blades 22.

The tip leakage steam does not surrender its momentum or kinetic energy to rotating blades 22. Its kinetic energy is instead converted to heat energy through turbulence and friction, thus raising its temperature, or superheat, to a level above the temperature and superheat of the steam that had flowed across rotating blades 22.

The portion of the steam path that is not through tip clearance 52 but rather is across rotating blades 22 is here named the main flow path, and the steam that passes through the main flow path is called the main flow steam.

A minor detail is that the steam flowing on the periphery of the steam path 36 is hotter than the main flow steam due to effects in addition to tip leakage, such as heating due to friction in the boundary layers attached to shroud band 46 and the carry over of tip leakage steam from upstream stages. For simplicity, the discussion here will only refer to tip leakage steam as a cause for the hot steam at the periphery of steam path 36.

The tip leakage steam, being situated on the extreme outside circumference of steam path 36, is extracted from the steam path through extraction gap 42. As the tip leakage steam is not of sufficient amount to supply the total needs of the feedwater heater, additional steam from main flow path 36, at lower temperature, will also be extracted through extraction gap 42 to supply the deficiency.

In the prior art turbine of FIG. 1, the width of extraction gap 42 is uniform around the entire circumference of turbine 10, so that the tip leakage steam is extracted through extraction gap 42 around the entire circumference. Thus, in turbine 10 of FIG. 1, all of the tip leakage steam is extracted.

It is known by those proficient in the science of thermodynamics that the amount of heating that may be performed by a given amount of steam is proportional to its enthalpy, while the amount of mechanical energy that the steam may produce in a turbine is proportional to its availability, which is given by the expression $h-T_0s$, where h is the enthalpy, $T_0$ is the absolute temperature in the condenser, and s is the entropy. It can be readily shown using published tables of the properties of steam that increasing the temperature, or superheat, of steam will increase both the enthalpy and the availability, but that the increase in the availability is proportionately greater than the increase in enthalpy.

For an example, consider steam at 200 psia, 800 degrees fahrenheit. Adding 50 degrees fahrenheit of superheat will increase the enthalpy by 1.8%, and the availability by 3.3%. Thus, the increase in potential mechanical energy is twice that of heat energy.

Increasing superheat of the steam flowing through the turbine will retard the formation of moisture droplets in the latter stages of the turbine. These moisture droplets are well known to reduce the efficiency of the latter stages, with a one percent increase in moisture resulting in approximately a one percent reduction in efficiency.

For these reasons, when two sources of steam are available, both at the same pressure but at different temperatures, and steam is needed for both heating feedwater and driving a turbine, it is advantageous to use the hotter steam for driving the turbine, and the colder steam for heating feedwater.

It will be remembered that the steam in steam path 36 in the vicinity of extraction gap 42 is at uniform pressure, but not at uniform temperature, the tip leakage steam being hotter than the main flow steam. Thus, it would be advantageous to retain the tip leakage steam within the turbine, extracting colder main flow steam for heating purposes. The problem of the prior art turbines of FIGS. 1 and 3 is that the hotter steam is all extracted, rather than being retained within the turbine where it could be used advantageously.

The failure to retain the hotter steam within the prior art turbines of FIGS. 1 and 3 reduces the amount of power produced in the turbines. This forces the owner of the turbine either to supply the turbine with a greater quantity of steam, at substantial cost, or to purchase power elsewhere, also at substantial cost, to make up for the deficiency.

The benefits of retaining hot steam in the steam path have been estimated for an operating 450,000 kilowatt power plant, using measurements of the pressure and temperature of steam at various points in the turbine taken during operation, in conjunction with computer simulations of the behavior of the turbine, feedwater heaters and related equipment. The measured operating data showed that the temperature of the steam in the extraction connection of the intermediate pressure turbine was about 45 degrees fahrenheit hotter than the temperature of the main flow steam in the adjacent steam path.

Computer simulations of the power plant showed that the electrical output would be increased by 250 kilowatts, without burning extra fuel, if two thirds of the hotter steam could be retained in the steam path, with main flow steam extracted in its place. 250 kilowatts has substantial value to companies engaged in the business of making power for sale. It is the amount of electric power needed to supply 250 homes at average rates of consumption.

SUMMARY OF THE INVENTION

An object of the invention is to remedy the shortcomings of the prior art, discussed above, by retaining a large fraction of the tip leakage steam within the turbine steam path where it will be most advantageously used, while allowing colder main flow steam to be extracted to the feedwater heater in its place, so that the total amount of heat energy supplied to the feedwater heater is essentially unchanged.

A particular object of the invention is to prevent the resulting loss in efficiency and the need to use more costly piping material that occurs under the prior art.

Another object of the invention is to minimize the pressure difference between the steam path and the extraction belt, in order to minimize any attendant loss in power plant efficiency.

In this invention, conventional turbine blade carriers are improved, using seals or barriers, to restrict or to otherwise close up the extraction gap in certain portions of the total circumference. The portions of the circumference where the extraction gap is so restricted or closed up are called inactive arcs. The portions of the circumference where the extraction gap is not so restricted or closed up are called the active arcs.

This improvement reduces the amount of hot tip leakage steam that is extracted to a fraction of that which is extracted in the prior art. Tip leakage steam in the vicinity of the active arcs will be extracted through the extraction gap, as in the prior art. However, the active arcs comprise only a portion of the total circumference. In the vicinity of the inactive arcs, tip leakage steam will not be able to escape through the extraction gap into the extraction belt, but will be confined to continue flowing through the turbine, advantageously using its relatively high amount of superheat to generate additional power.

The amount of steam extracted to the feedwater heater formerly consisting of tip leakage steam flowing through the now inactive arcs will be supplied by colder main flow steam in the vicinity of the active arcs. The steam flowing through the connecting piping will be colder than is the case in the prior art, and costly piping materials tolerant of high temperatures will be less needed.

In another aspect of the invention, the width of the extraction gap in the active arcs is increased. The increased width of the extraction gap in the active arcs minimizes the pressure difference needed to force the extracted steam from the steam path through the extraction gap into the extraction belt. The minimizing of the pressure difference minimizes the efficiency loss associated with that pressure difference.

The invention is a means and method for retaining highly superheated steam within the steam path of a turbine, causing steam with less superheat to be extracted in its place, so that the total amount of steam extracted is essentially unchanged. The efficiency of a power plant is improved if highly superheated steam is retained in the turbine.

DESCRIPTION OF THE PREFERRED EMBODIMENTS

Figure 2:
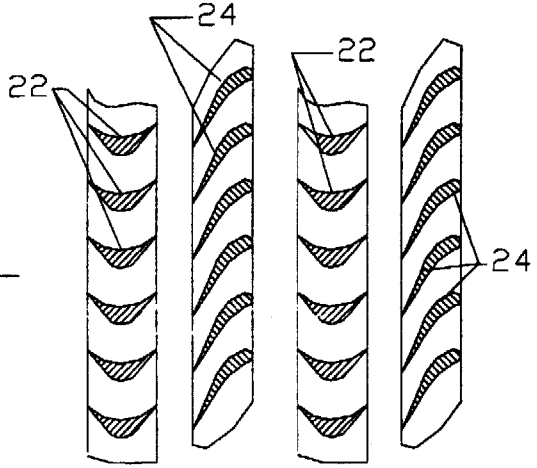
FIG. 2 (PRIOR ART)
FIG. 2 is a fragmentary, somewhat schematic cross sectional view of two rows each of rotating and stationary blades of the steam turbine of FIG. 1, showing the flow path of the steam through the spaces between the blades.

By means of the invention hereof, the shortcomings of the prior art, discussed above, are remedied by retaining a large fraction of the tip leakage steam within the turbine steam path where it will be most advantageously used, while allowing colder main flow steam to be extracted to the feedwater heater in its place, so that the total amount of heat energy supplied to the feedwater heater is essentially unchanged, thereby preventing the resulting loss in efficiency and the need to use more costly piping material that occurs under the prior art.

In addition, the pressure difference between the steam path and the extraction belt is minimized in order to reduce to a minimum any attendant loss in power plant efficiency.

A preferred embodiment of the invention is shown in FIGS. 6–8 and 11, wherein an extraction gap 242 of a turbine 210 is bridged from a blade carrier 226 to a blade carrier 228 by a seal 260 which is locked into a groove 262 provided in blade carrier 228. Seal 260 has a curved end 263 which presses against blade carrier 226.

Seal 260 is preferably manufactured from a material with good spring qualities so that it may accommodate slight movements and expansions of blade carriers 226 and 228 without permanent deformation.

Figure 1:
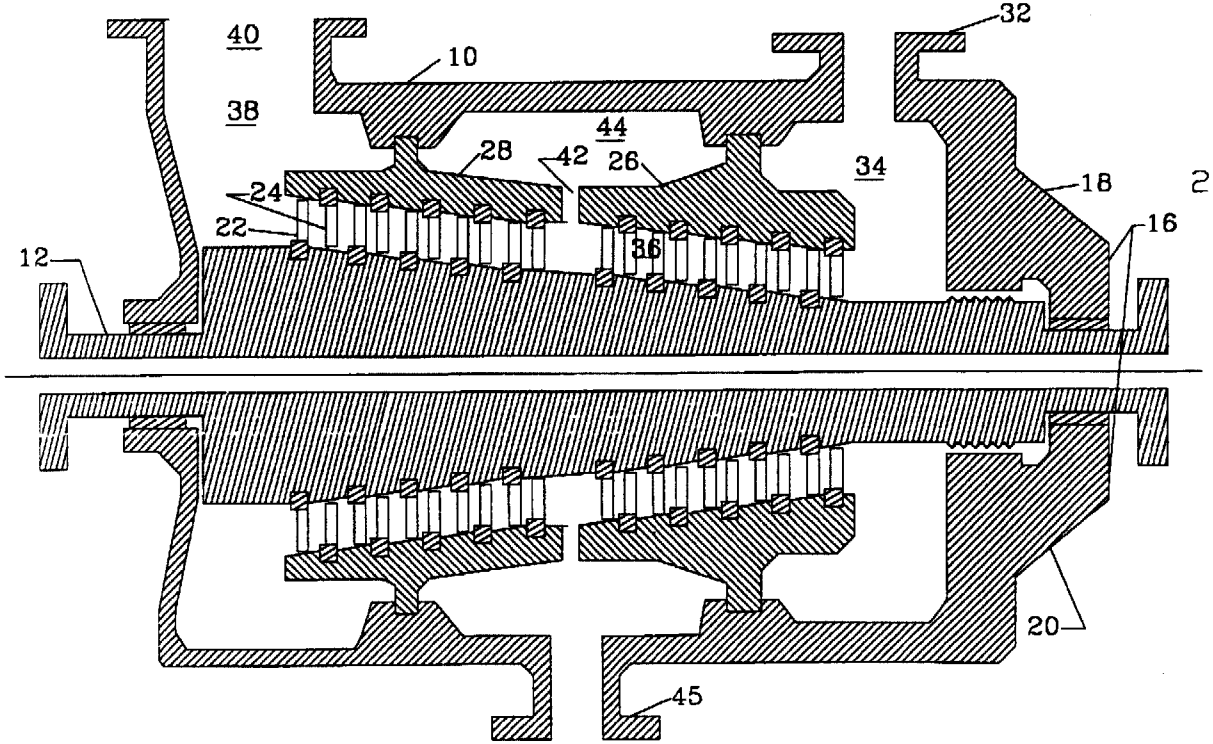
FIG. 1 (PRIOR ART)
FIG. 1 is a longitudinal cross sectional view through one form of typical steam turbine having conventional prior art arrangements for extracting steam for heating purposes from the steam path into an extraction belt through an extraction gap between blade carriers, with the shroud band and tip seal omitted.

It can be seen that seal 260 acts as a barrier to prevent the flow of steam through extraction gap 242 into an extraction belt 244, and thence to an extraction connection 246 similar to extraction connection 45 of FIG. 1.

Tip leakage steam in the adjacent steam path is thus prevented from escaping from steam path 236 into extraction gap 242.

Figure 6:
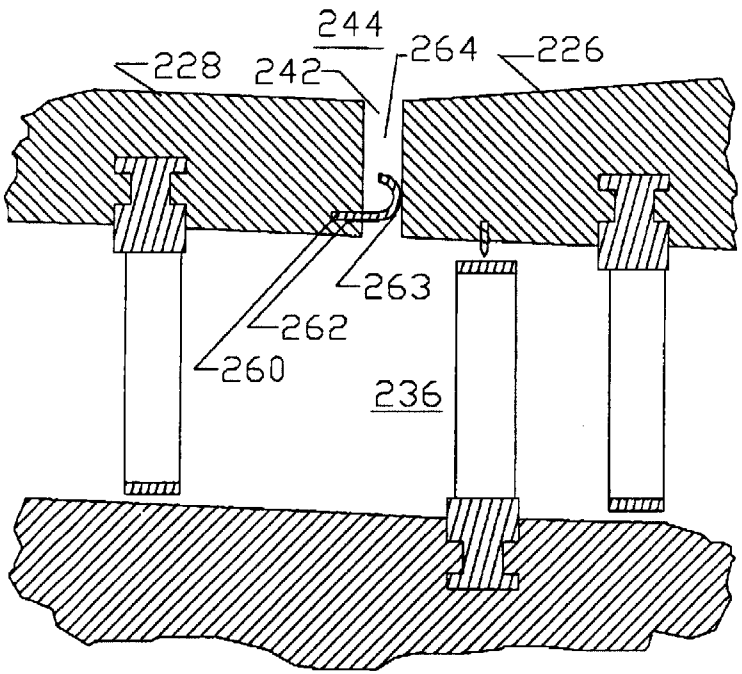
FIG. 6 is an enlarged, fragmentary cross sectional view taken on line 6—6 of FIG. 8 of a turbine embodying the invention illustrating the extraction gap and the adjacent steam path, in one of the portions of the circumference called an inactive arc.

As shown in FIG. 6, seal 260 is attached to downstream blade carrier 228. It may alternatively be attached to upstream blade carrier 226.

The area of extraction gap 242 bridged by seal 260 is called an inactive arc and is indicated by the numeral 264.

Figure 8:
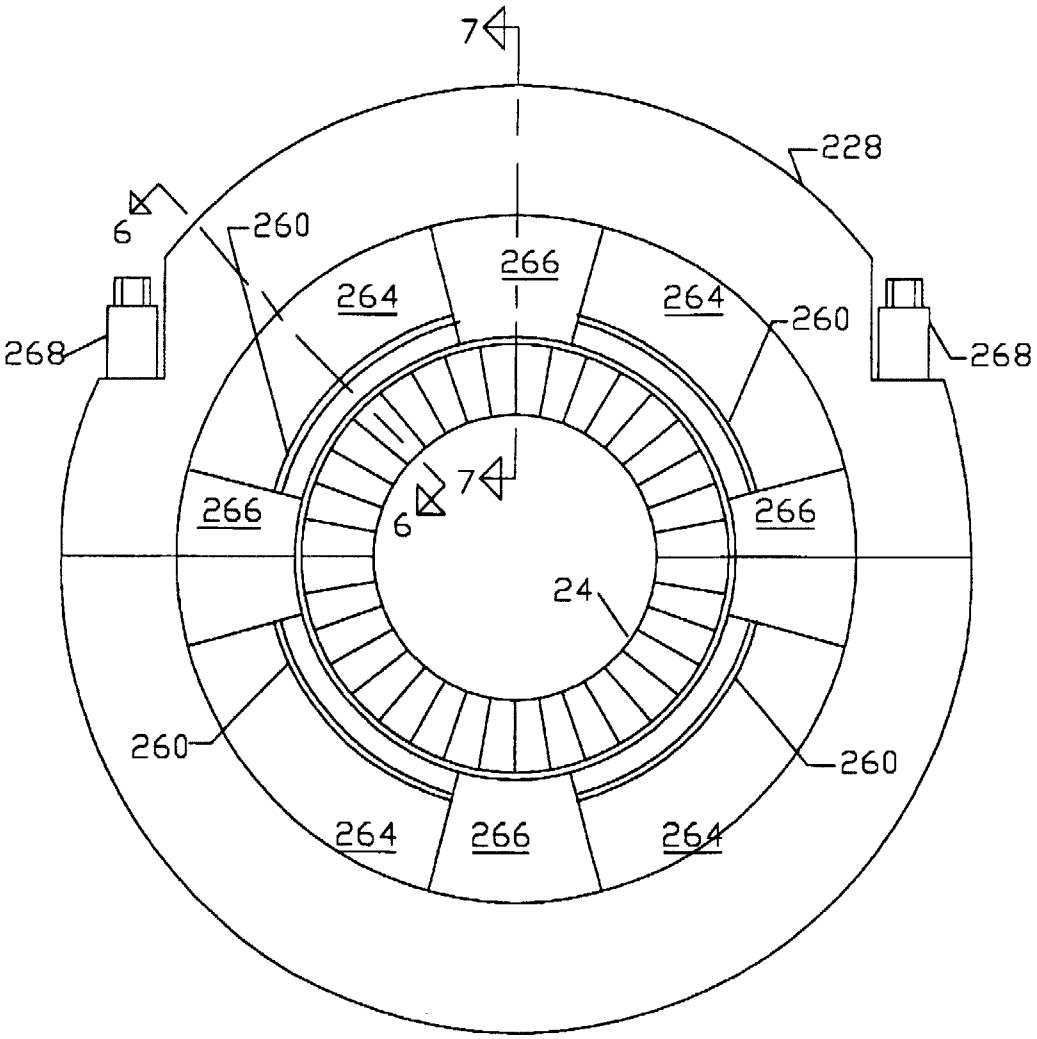
FIG. 8 is an axial view of the blade carrier of a turbine embodying the invention in the direction of the turbine axis, illustrating active and inactive arcs.

As seen in FIG. 8, there are four such inactive arcs 264 provided at circumferentially spaced locations of the turbine.

Figure 7:
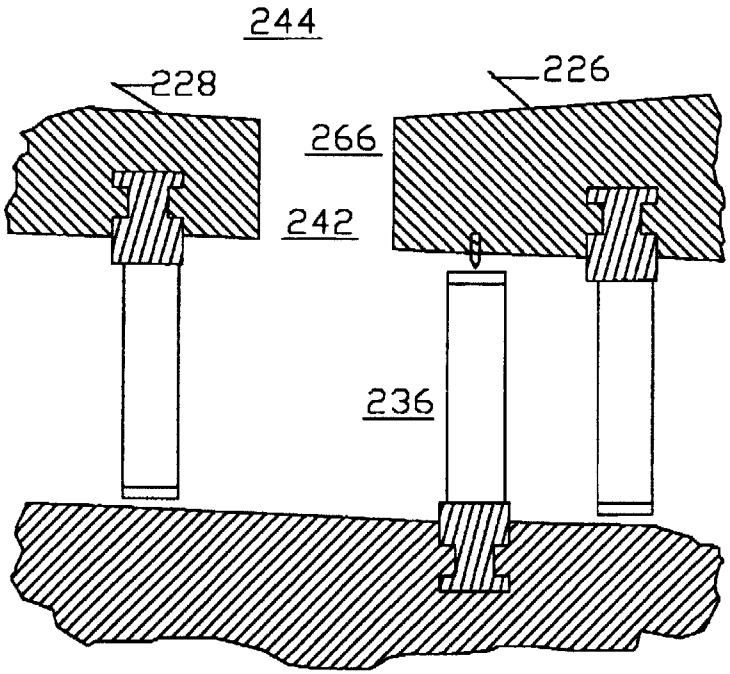
FIG. 7 is an enlarged, fragmentary cross sectional view taken on line 7—7 of FIG. 8 of a turbine embodying the invention, illustrating the same extraction gap and adjacent steam path as in FIG. 6 but at one of the remaining portions of the circumference, called an active arc.

As shown in FIG. 7, extraction gap 242 has been enlarged in width by eliminating some of the material of blade carrier 228. This is done for the purpose of minimizing the pressure difference between steam path 236 and extraction belt 244.

The extraction gap could alternatively be enlarged by the elimination of some of the material from upstream blade carrier 226, or, alternatively, from both blade carriers.

This area of extraction gap 242 is called an active arc and is indicated by the numeral 266.

Figure 3:
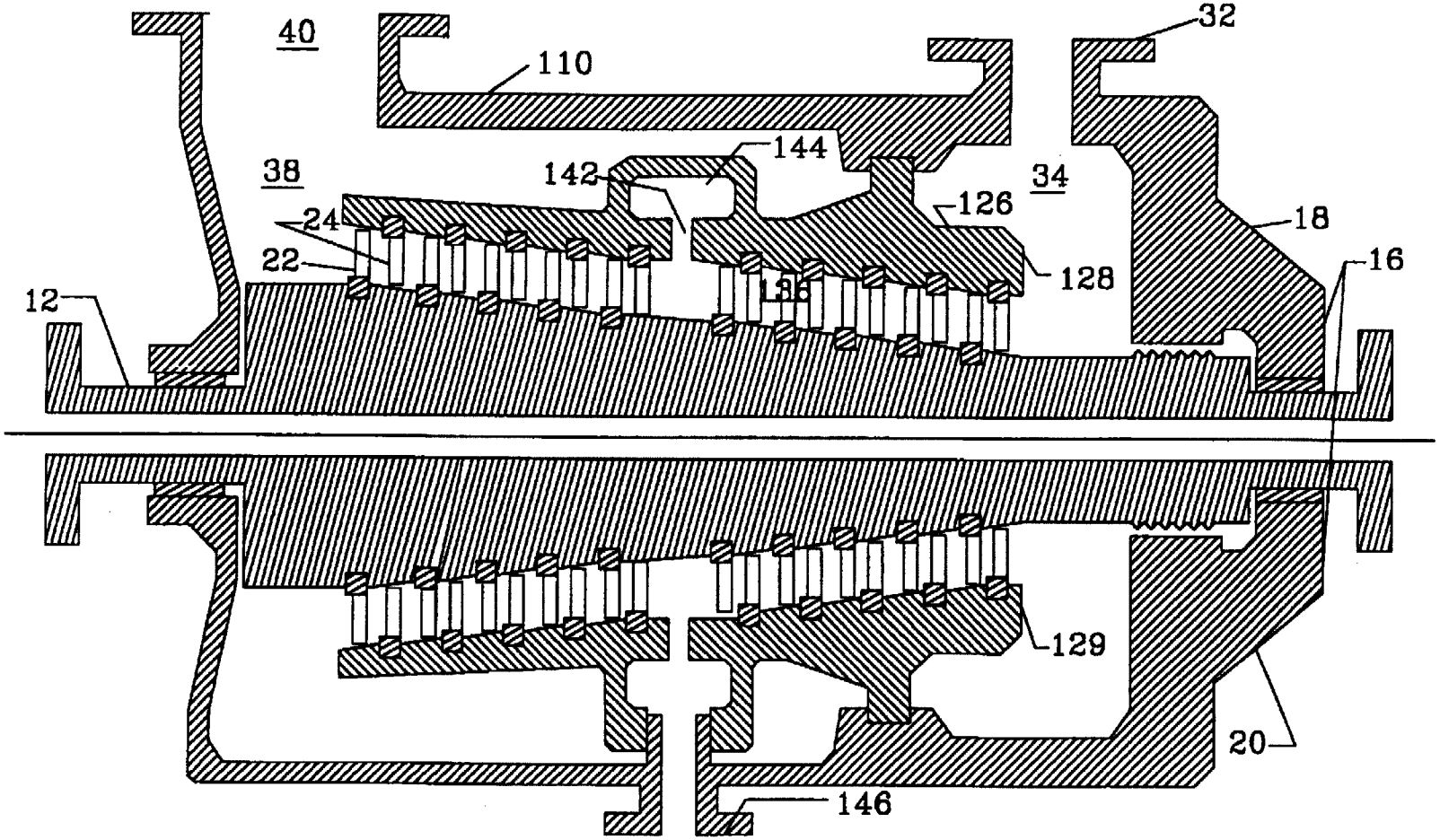
FIG. 3 (PRIOR ART)
FIG. 3 is a longitudinal cross sectional view through another form of typical steam turbine having conventional prior art arrangements for extracting steam for heating purposes from the steam path into an extraction belt through an extraction gap within a single blade carrier with the shroud band and tip seal omitted.
Figure 5:
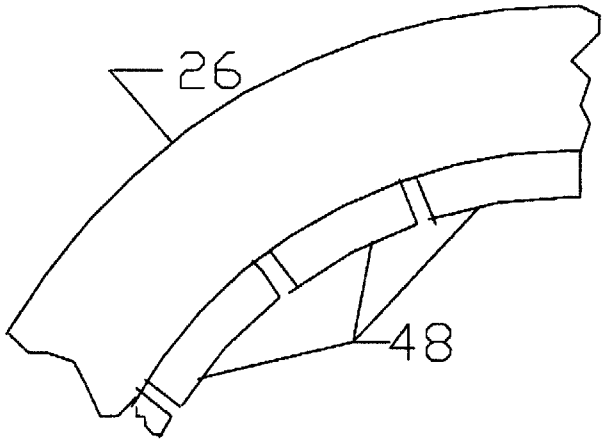
FIG. 5 (PRIOR ART)
FIG. 5 is an enlarged, fragmentary, axial cross sectional view of a portion of a prior art blade carrier and tip seal.
Figure 4:
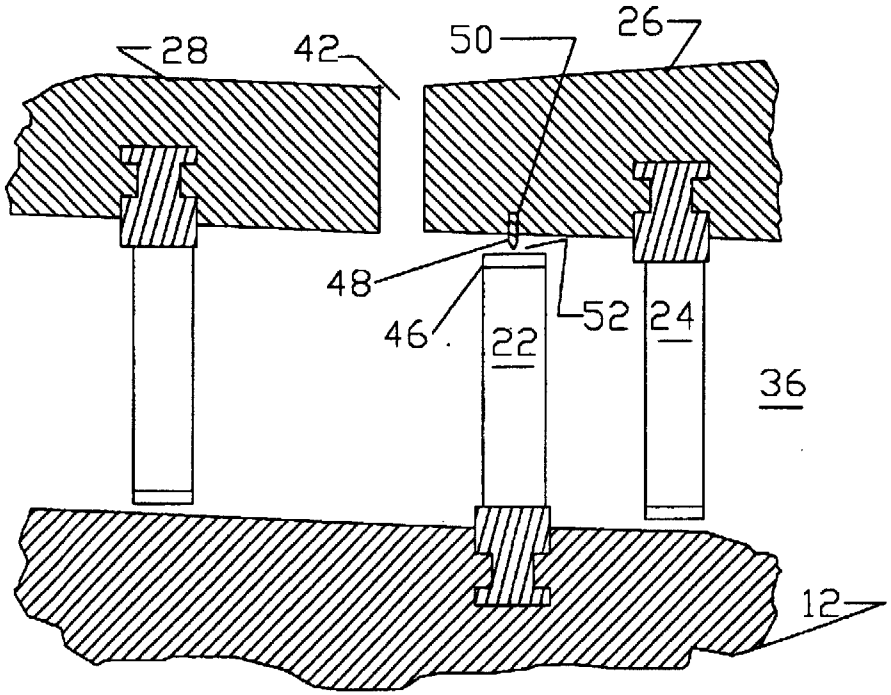
FIG. 4 (PRIOR ART)
FIG. 4 is an enlarged, fragmentary, longitudinal cross sectional view of the extraction gap and the adjacent steam path of the prior art turbine of FIG. 1, with the shroud band and tip seal included.
Figure 11:
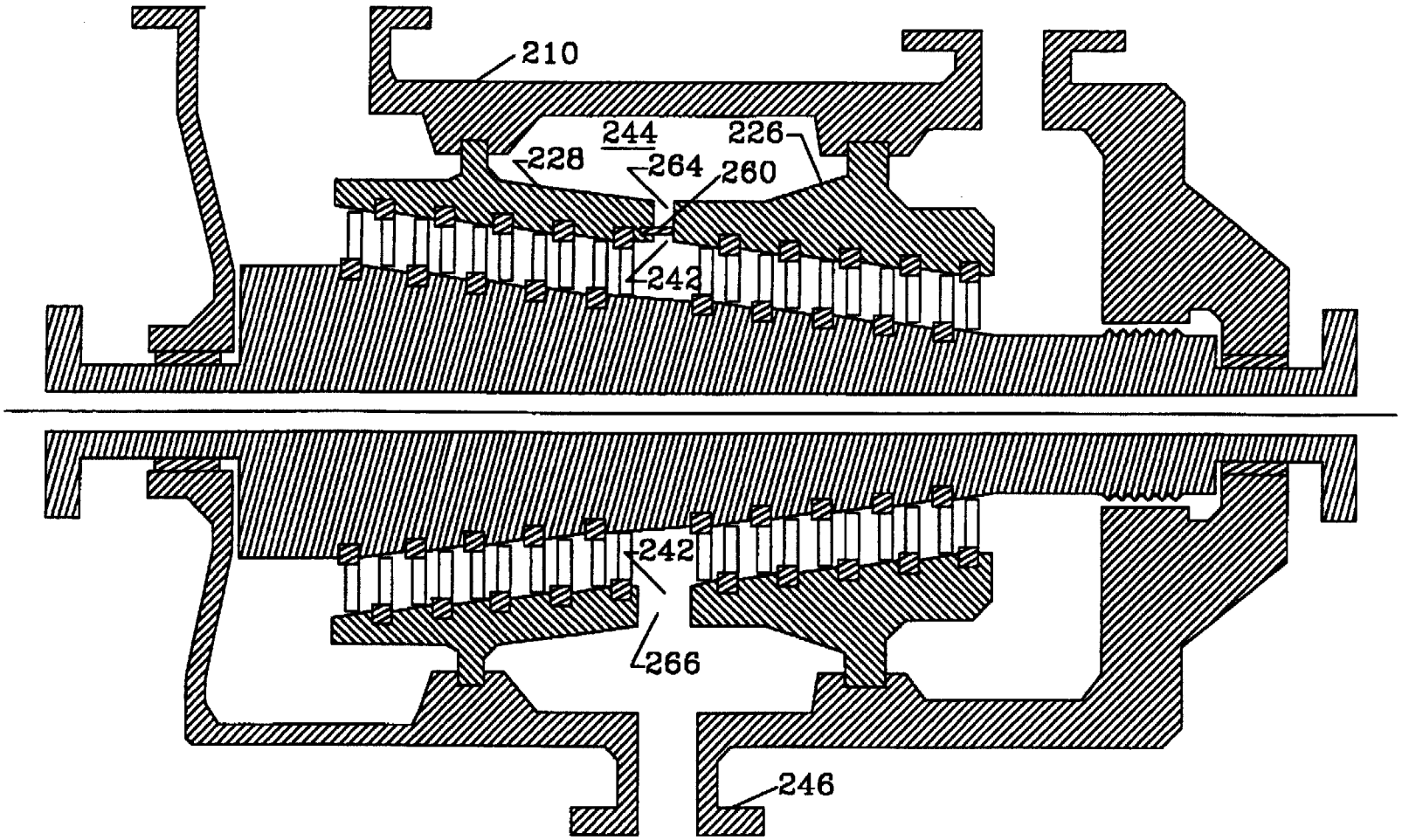
FIG. 11 is a longitudinal cross sectional view of a steam turbine similar to that shown in FIG. 1 but embodying features of the invention illustrating an extraction gap, with an inactive arc shown in the top half of the turbine and an active arc shown in the bottom half of the turbine.

Unless extraction gap 242 were widened as shown in FIGS. 7 and 11, this would result in an increase in pressure difference over that of the prior art turbines of FIGS. 1 and 3 between steam path 236 and extraction belt 244.

FIG. 8 is an axial view of blade carrier 228, and stationary blades 24, with rotor 12 omitted.

Blade carrier 228 is divided into upper and lower halves which are held together during operation by studs, not shown, fastened using nuts 268.

As seen in FIG. 8, there are four such active arcs 266 provided at circumferentially spaced locations of the turbine at 0°, 90°, 180° and 360°, with inactive arcs 264 being disposed between active arcs 266.

Seals 260 are disposed only in the areas of inactive arcs 264, not in the areas of active arcs 266.

FIG. 8 illustrates four active and four inactive arcs 264, symmetrically distributed around the circumference. Other numbers of active and inactive arcs, not necessarily symmetric, may alternatively be employed.

It will be recalled that extraction gap 242 in the area of inactive arc 264 has been closed to the flow of steam by seal 260, as shown in FIG. 6.

Thus, all of the extraction steam requirements must be supplied through active arcs 266. The flow of steam through extraction gap 242 in the active arc 266 will be greater than the flow of steam through extraction gaps 42, 142 in the comparable portions of the circumference in the prior art turbines of FIGS. 1 and 3.

FIG. 11 shows the turbine illustrated in FIG. 1, but embodying improvements of the invention. An inactive arc, 264, is shown on the top of the turbine. Seal 260 closes the extraction gap preventing the extraction of steam from this portion of the circumference of the steam path. An active arc 266 is shown on the bottom of the turbine. The extraction gap has been widened in the active arc to minimize loss of pressure.

While a J-shaped seal 260 has been illustrated in FIG. 6, a wide variety of seals of other configurations may be employed, such as may be suggested by the experience of those proficient in the art of detailed turbine design.

Figure 9:
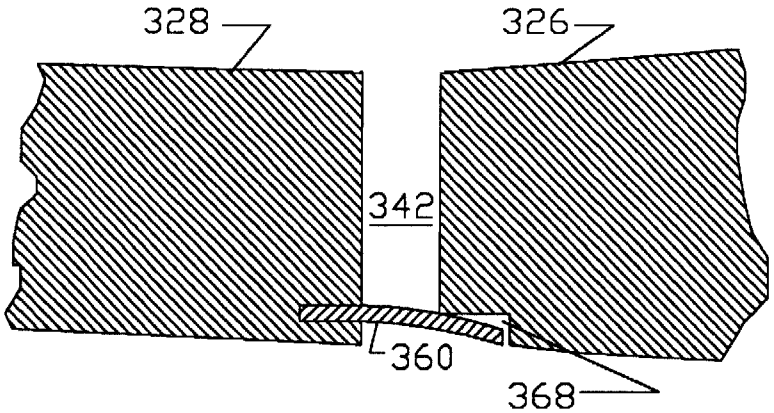
FIGS. 9 and 10 are fragmentary, cross sectional views of the extraction gap of turbines embodying the invention in the region of the inactive arc, illustrating alternative seal arrangements.
Figure 10:
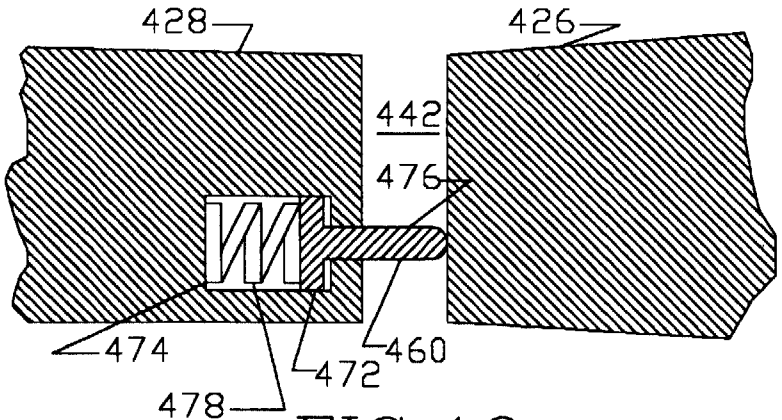

FIGS. 9 and 10 illustrate two of the many other possible seal arrangements.

In FIG. 9, a flat seal 360 extends across an extraction gap 342. One end of seal 360 is locked in a blade carrier 328, and a free end of seal 360 is receivable in a notch 368 in blade carrier 326.

FIG. 10 illustrates a T-shaped seal 460 of heavy construction having a head 472 receivable in a provided opening 474 in a blade carrier 428 and a shank 476 which extends outwardly from opening 474 and from blade carrier 428 to bridge an extraction gap 442 and has a free end which contacts a blade carrier 426.

Seal 460 is spring-loaded as by a coil spring 478 disposed in opening 474 of blade carrier 428 and bearing against the head 472 of the seal.

Figure 12:
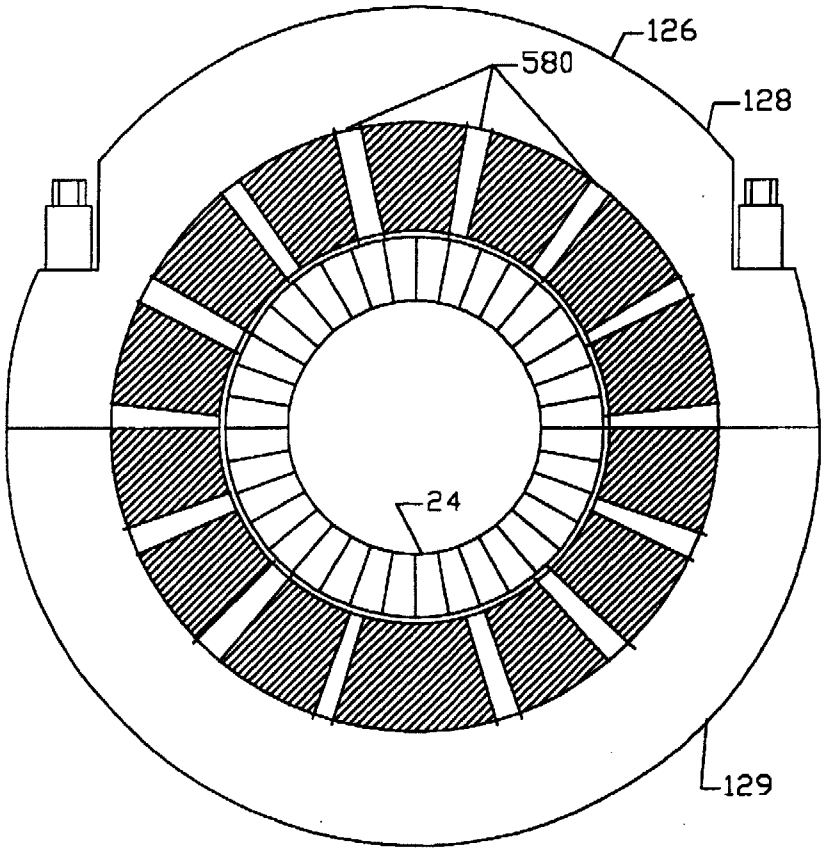
FIG. 12 (PRIOR ART)
FIG. 12 is an axial cross sectional view through a blade carrier of another form of typical steam turbine having conventional prior arrangements for extracting steam for heating purposes from the steam path into an extraction belt, similar to FIG. 3, but with a number of extraction holes through the blade carrier, rather than an extraction gap, spaced evenly around the circumference.

In FIG. 12, a prior art single blade carrier 126 is shown in axial cross section, looking toward the exhaust.

Single blade carrier 126 is divided into an upper half 128 and a lower half 129 and supports stationary blades 24 on both sides of the extraction.

The downstream stationary blades 24 are shown.

In FIG. 12, several discrete extraction holes 580 extend through blade carrier 126 and are spaced more or less evenly around the circumference to allow steam to flow from the steam path into the extraction belt, not shown.

Extraction holes 580 replace the prior art extraction gap 142 of FIG. 3.

Figure 13:
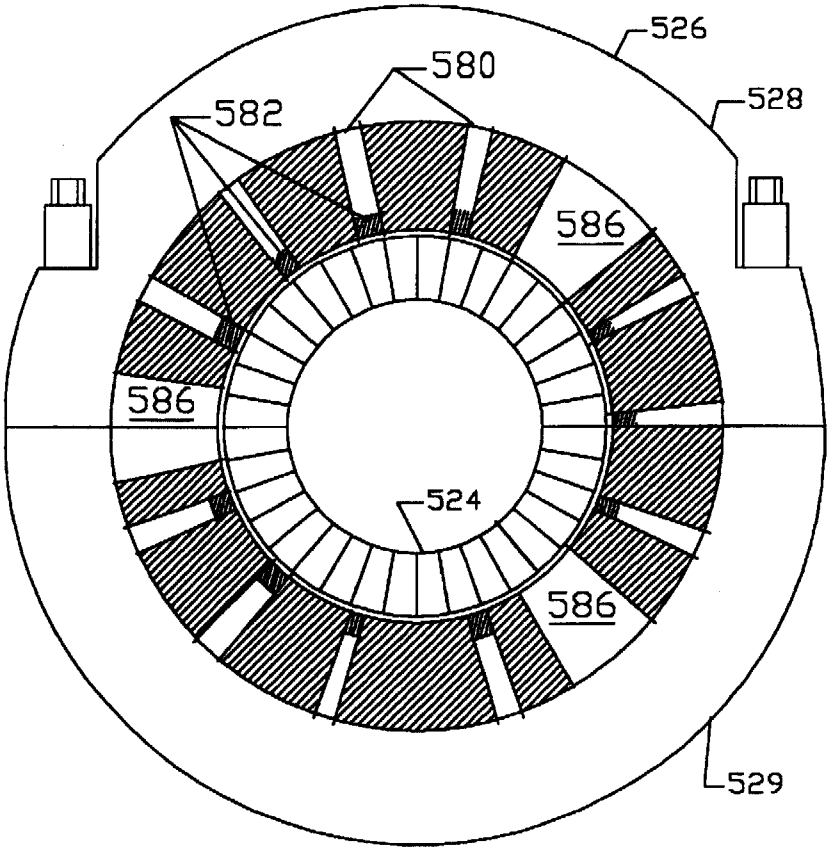
FIG. 13 is an axial cross sectional view similar to FIG. 12 through a blade carrier embodying the invention, but with several of the holes sealed over portions of the circumference called inactive arcs, and with holes enlarged in the remaining portions of the circumference, called active arcs.

FIG. 13 is an axial cross sectional view similar to FIG. 12, looking toward the exhaust, but showing a single blade carrier 526 embodying the invention.

Blade carrier 526 is divided into an upper half 528 and a lower half 529 with spaced extraction holes 580' spaced around the circumference, with certain of the extraction holes being closed by seals 582 to define inactive arcs over portions of the circumference and having certain of extraction holes 586 enlarged in size to define active arcs in the remaining portions of the circumference.

In lieu of enlarged extraction holes 586, the active arc may be defined by an increased number of extraction holes in the remaining portions of the circumference.

It should be pointed out that in the matter of details in the design of the blade carriers and seals, the various practitioners of the turbine art have their own preferences and proprietary technology, and that all possible combinations cannot be shown here. The benefit of this invention is independent of the details of the design of the seals and blade carriers used in its embodiment. Its benefit is derived from the restriction of the extraction flow to only a portion of the circumference of the steam path, thereby advantageously retaining within the turbine the more superheated steam that is present at the periphery of the steam path.

It will be understood that the above description of the present invention is subject to various modifications, changes, and adaptations, and that the same are intended to be comprehended within the range of equivalents of the appended claims.

I claim:

1. In a turbine inclusive of a turbine rotor with a longitudinal axis, and a main steam path consisting of rows of stationary and moving blades, the moving blades being connected to the rotor and having tip seals on their free ends, with a cylinder surrounding the assembly and with the tip seals creating a tip seal clearance space through which steam may also flow, with blade carriers supported by the cylinder and supporting in turn the stationary blades, and with an extraction gap between certain blade carriers through which steam is extracted from the main steam path and from the tip seal clearance space for heating purposes, the improvement comprising: sealing means blocking the extraction gap over spaced portions of its circumference, preventing the extraction of steam from the tip seal clearance space and from the adjacent portions of the steam path, with the remaining portions of the extraction gap remaining unrestricted, whereby the extracted steam must pass through the remaining portions of the gap.

2. In a turbine as set forth in claim 1, wherein the extraction gap is enlarged in certain portions of the circumference, whereby a disproportionate share of the extraction steam is taken from the steam path adjacent to these portions without effecting of a large pressure difference.

3. In a turbine as set forth in claim 1, the sealing means being positively attached to the blade carrier on both sides of the gap.

4. In a turbine as set forth in claim 1, the sealing means being positively attached to the blade carrier on one side of the gap and being pressed against the blade carrier on the other side of the gap.

5. In a turbine inclusive of a turbine rotor with a longitudinal axis, and a steam path consisting of rows of stationary and moving blades, the moving blades being connected to the rotor, with a cylinder surrounding the assembly and, with blade carriers supported by the cylinder and supporting in turn the stationary blades, and with two or more rows of stationary blades being supported by the same blade carrier and with a gap between supports of certain adjacent rows of stationary blades, through which steam may be extracted from the steam path toward a collecting chamber, the improvement comprising: sealing means blocking the gap over spaced portions of the circumference preventing the extraction of steam from the adjacent portions of the steam path, with the remaining portions of the gap remaining open whereby the extracted steam must pass through the remaining portions of the gap.

6. In a turbine as set forth in claim 5, wherein the extraction gap is enlarged in certain portions of the circumference, whereby a disproportionate share of the extraction steam is taken from the steam path adjacent to these portions without effecting of a large pressure difference.

7. In a turbine as set forth in claim 5, the sealing means being positively attached to the blade carrier on both sides of the gap.

8. In a turbine as set forth in claim 5, the sealing means being positively attached to the blade carrier on one side of the gap and being pressed against the blade carrier on the other side of the gap.

* * * * *